US008699897B2

(12) United States Patent
Soda

(10) Patent No.: US 8,699,897 B2
(45) Date of Patent: Apr. 15, 2014

(54) IMAGE FORMING APPARATUS CAPABLE OF SAVING ENERGY, METHOD OF CONTROLLING THE SAME, AND STORAGE MEDIUM

(75) Inventor: Yuji Soda, Kawasaki (JP)

(73) Assignee: Canon Kabushiki Kaisha (JP)

( * ) Notice: Subject to any disclaimer, the term of this patent is extended or adjusted under 35 U.S.C. 154(b) by 184 days.

(21) Appl. No.: 13/305,998

(22) Filed: Nov. 29, 2011

(65) Prior Publication Data

US 2012/0134692 A1 May 31, 2012

(30) Foreign Application Priority Data

Nov. 29, 2010 (JP) ..... 2010-264962

(51) Int. Cl.
*G03G 15/00* (2006.01)

(52) U.S. Cl.
USPC ..... 399/44

(58) Field of Classification Search
USPC ..... 399/44, 69
See application file for complete search history.

(56) References Cited

U.S. PATENT DOCUMENTS

2007/0086807 A1* 4/2007 Kuma et al. ..... 399/121
2010/0104301 A1* 4/2010 Kato ..... 399/44

FOREIGN PATENT DOCUMENTS

JP 2006227395 A 8/2006

* cited by examiner

*Primary Examiner* — Walter L Lindsay, Jr.
*Assistant Examiner* — Frederick Wenderoth
(74) *Attorney, Agent, or Firm* — Rossi, Kimms & McDowell, LLP

(57) ABSTRACT

An image forming apparatus which makes it possible to save energy during the operation of a temperature rise control mode, and is capable of realizing energy saving without degrading performance by making the image forming apparatus ready for printing when returning from the temperature rise control mode. A temperature sensor detects internal temperature of the image forming apparatus. When the internal temperature of the image forming apparatus has reached a temperature at which the apparatus should shift to the temperature rise control mode during execution of printing, the printing operation is stopped. In stopping the printing operation, the image forming apparatus is shifted to an energy saving mode.

7 Claims, 7 Drawing Sheets

CONTROL UNIT
224
CPU
101
CONTROL SIGNAL
I/F CIRCUIT A
110
103
PWM
102
VIDEO TRANSFER CIRCUIT
114
PLL
115
CLK
I/F CIRCUIT B
111
I/F CIRCUIT C
112
I/F CIRCUIT D
113
RAM SECTION
104
ROM SECTION
105
EXTERNAL I/F
VIDEO SIGNAL
ENGINE CONTROLLER
106
TEMPERATURE SENSOR
109
HEATER CON-TROLLER
108
FIXING HEATER
120
POWER SUPPLY UNIT
107
SUPPLY VOLTAGE A
SUPPLY VOLTAGE B

IMAGE FORMING APPARATUS CAPABLE OF SAVING ENERGY, METHOD OF CONTROLLING THE SAME, AND STORAGE MEDIUM

BACKGROUND OF THE INVENTION

1. Field of the Invention

The present invention relates to an image forming apparatus, such as a copying machine or a printer, including a control unit for saving energy, a method of controlling the image forming apparatus, and a storage medium.

2. Description of the Related Art

In general, the price of an image forming apparatus, such as a copying machine or a printer, has been progressively reduced, and therefore demand for price reduction of a control unit for controlling a printer has been increasing.

Further, printers configured to print out an image based on print data received from a host computer include a host-based type that employs, with a view to cost reduction, a printing method in which a host computer rasterizes print data into a format which can be output by the printer, and then delivers the rasterized data to the printer.

As such printers described above, with a tendency toward reduction of apparatus size and price, there has appeared a type which is configured to dispense with a cooling unit, such as a fan. Further, some printers of this type are provided with a temperature rise control mode in which a predetermined cooling time is provided when the printer internal temperature has risen, thereby disabling a printing operation until the printer internal temperature falls.

Further, there has conventionally been proposed a printer that achieves energy saving by preventing wasteful heater energization (see Japanese Patent Laid-Open Publication No. 2006-227395). In this printer, it is determined whether or not a printing device is in an energy saving state, or whether or not the temperature of a fixing unit is a temperature ready for printing when data is received by a data reception unit. If the printer is not in the energy saving state, or if the temperature is a temperature ready for printing, printing is performed, whereas if the printer is in the energy saving state, or if the temperature is not a temperature ready for printing, the received data is accumulated in an accumulation unit, and the printing is not performed. This prevents wasteful heater energization to thereby achieve energy saving.

In the field of small-sized printers, development of a printer without a cooling unit, such as a fan, has been proceeding so as to achieve reduction of apparatus size and costs.

In such a printer having no cooling unit, however, when continuous printing is performed, the printer internal temperature rises in a short time, and hence the printer shifts to the temperature rise control mode.

In such a small-sized printer provided with the temperature rise control mode and loaded with a small-sized cartridge, such an operation process is followed as illustrated, by way of example, in a timing diagram in FIG. 5 which shows printing time in continuous printing. In the operation process illustrated in FIG. 5, when continuous printing is started by a printer, the printer internal temperature rises and the printer shifts to the temperature rise control mode after printing of several tens of sheets. As a consequence, the printing operation is suspended until the printer internal temperature falls.

At this time, the printer is on standby while maintaining a state in which the printing operation can be resumed when the internal temperature falls by suspending the printing operation. Therefore, in the printer, during the temperature rise control mode, electric power is also supplied to functions which are not necessary when on standby, which causes wasteful electric power consumption.

Particularly, when continuous printing continues, the printing operation is performed while alternately repeating printing and the temperature rise control mode, which causes wasteful electric power consumption. Further to this, there is a problem that when continuous printing continues, the temperatures of a power supply unit and other units rise, which causes a delay in cooling the internal temperature of the apparatus.

SUMMARY OF THE INVENTION

The present invention provides an image forming apparatus which makes it possible to save energy during the operation of a temperature rise control mode, and is capable of realizing energy saving without degrading performance by making the image forming apparatus ready for printing when returning from the temperature rise control mode, a method of controlling the image forming apparatus, and a storage medium.

In a first aspect of the present invention, there is provided an image forming apparatus that can enter a first state, and a second state in which power consumption is smaller than in the first state, as different states of an electric power state, comprising a printing unit configured to print an image on a sheet, a detection unit configured to detect internal temperature of the image forming apparatus, a control unit configured to control in a case where it is detected by the detection unit that the internal temperature of the image forming apparatus has become equal to or higher than a first temperature during execution of printing by the printing unit, the printing unit to stop an operation of printing executed by the printing unit, and a power control unit configured to shift the electric power state of the image forming apparatus from the first state to the second state in a case where the control unit stops the operation of printing executed by the printing unit.

In a second aspect of the present invention, there is provided a method of controlling an image forming apparatus that can enter a first state, and a second state in which power consumption is smaller than in the first state, as different states of an electric power state, comprising printing an image on a sheet, detecting internal temperature of the image forming apparatus, causing, in a case where it is detected by the detecting that the internal temperature of the image forming apparatus has become equal to or higher than a first temperature during execution of printing, an operation of printing to be stopped, and shifting the electric power state of the image forming apparatus from the first state to the second state when stopping the operation of printing.

In a third aspect of the present invention, there is provided a non-transitory computer-readable storage medium storing a computer-executable program for causing a computer to execute a method of controlling an image forming apparatus that can enter a first state, and a second state in which power consumption is smaller than in the first state, as different states of an electric power state, wherein the method comprises printing an image on a sheet, detecting internal temperature of the image forming apparatus, causing, in a case where it is detected by the detecting that the internal temperature of the image forming apparatus has become equal to or higher than a first temperature during execution of printing, an operation of printing to be stopped, and shifting the electric power state of the image forming apparatus from the first state to the second state when stopping the operation of printing.

According to the present invention, it is possible to save energy during the operation of the temperature rise control mode, and realize energy saving without degrading performance by making the image forming apparatus ready for printing when returning from the temperature rising control mode.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 2:
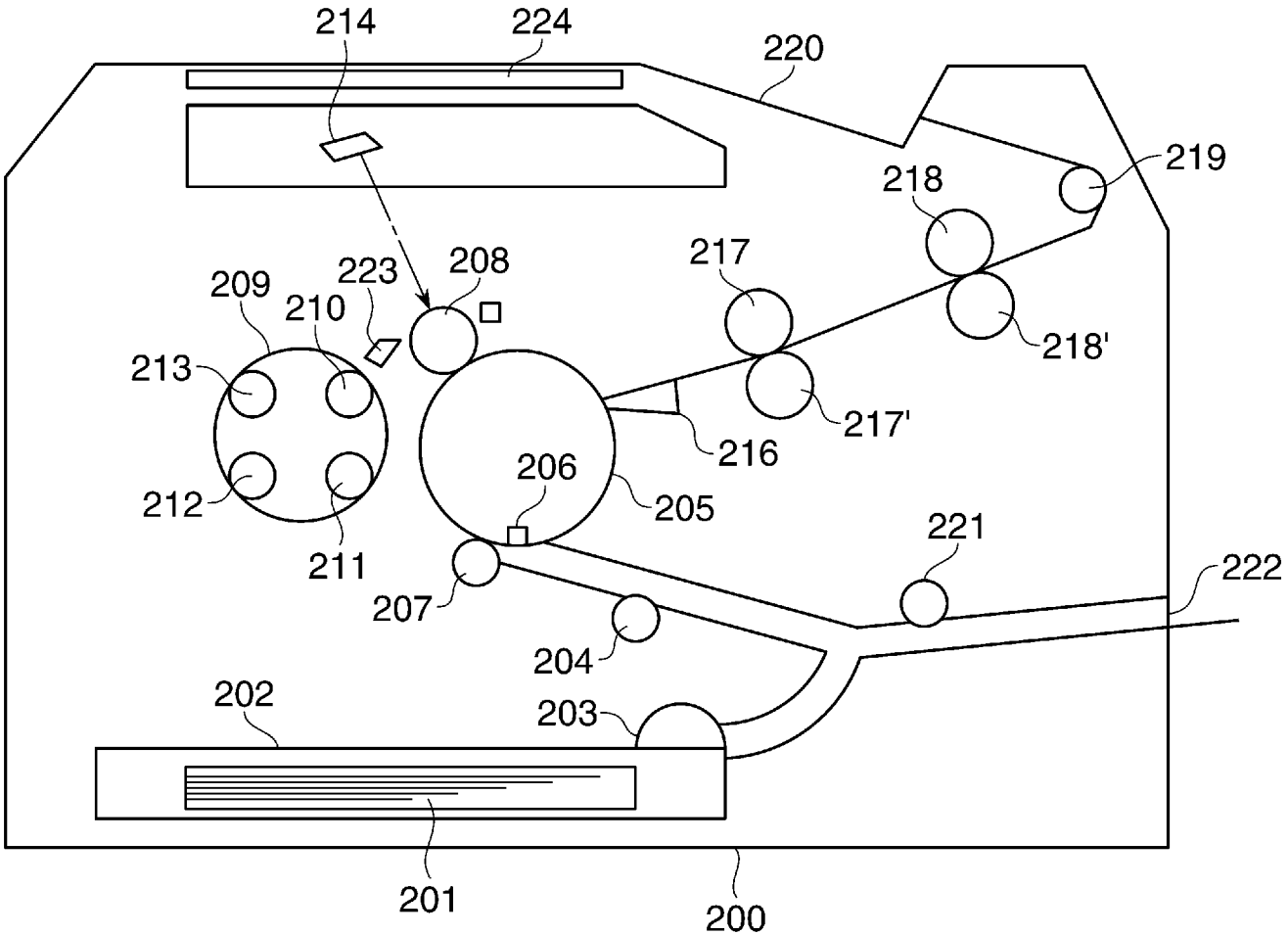
FIG. 2 is a schematic cross-sectional view of the image forming apparatus according to the embodiment.

FIG. 2 is a schematic cross-sectional view of an image forming apparatus according to the present embodiment. In FIG. 2, reference numeral 200 denotes a laser beam printer as the image forming apparatus. The laser beam printer 200 receives images, characters, and the like data from various kinds of external apparatuses including a host computer, and forms and outputs images, characters, etc. on recording media.

In FIG. 2, reference numeral 201 denotes sheets as recording media, and 202 denotes a sheet cassette holding the sheets 201.

In FIG. 2, reference numeral 203 denotes a cassette sheet-feeding clutch that separates only an uppermost one of the sheets 201 set in the sheet cassette 202. The cassette sheet-feeding clutch 203 has a portion thereof formed into a cam shape, and is rotated by a drive unit, not shown, for feeding the sheets 201 separately one by one. The cassette sheet-feeding clutch 203 conveys each separate sheet until the leading edge of the sheet reaches a sheet feed roller 204. Thus, the cassette sheet-feeding clutch 203 operates to feed one sheet 201 per single rotation thereof. The sheet feed roller 204 performs rotation while slightly pressing a sheet 201 conveyed by the cassette sheet-feeding clutch 203, to thereby further convey the sheet 201.

In FIG. 2, reference numeral 222 denotes a sheet tray, and 221 denotes a manual sheet feeding clutch. The sheet tray 222 and the manual sheet feeding clutch 221 make it possible to manually feed sheets one by one from the sheet tray 222. Thus, sheet feeding is enabled not only from the sheet cassette 202, but also from the sheet tray 222.

In FIG. 2, reference numeral 205 denotes a transfer drum, reference numeral 206 denotes a gripper for nipping the leading end of a sheet, and reference numeral 207 denotes a conveying roller. During a printing operation, the transfer drum 205 rotates at a predetermined speed. When the transfer drum 205 rotates and brings the gripper 206 thereon to the leading end of the sheet, the gripper 206 nips the leading end of the sheet. Thereafter, the sheet 201 is wound around the transfer drum 205 in accordance with rotation of the conveying roller 207 and is conveyed.

In FIG. 2, reference numeral 208 denotes a photosensitive drum, reference numeral 209 denotes a developing device holder, reference numeral 210 denotes a yellow (Y) toner developing device, reference numeral 211 denotes a magenta (M) toner developing device, reference numeral 212 denotes a cyan (C) toner developing device, and reference numeral 213 denotes a black (K) toner developing device.

The developing device holder 209 is intermittently rotated through a predetermined angle to move one of the developing devices of a desired color toner to a development position on the photosensitive drum 208.

In FIG. 2, reference numeral 214 denotes a laser driver. The laser driver 214 turns on and off a semiconductor laser according to dot data delivered from a control unit 224 (see FIG. 1). As a consequence, the laser driver 214 scans the surface of the photosensitive drum 208 in the main scanning direction by a modulated laser beam to thereby form an electrostatic latent image along a main scan line. At this time, the rotation of the photosensitive drum 208 is controlled such that the location of the formed latent image is synchronized with the location of the sheet 201 on the transfer drum 205. Through this operation of the photosensitive drum 208, the surface of the photosensitive drum 208, which has been charged by a charger, not shown, has the latent image for one page formed thereon by being exposed to the laser beam produced by the laser driver 214.

The latent image thus formed on the photosensitive drum 208 is developed as a toner image by a predetermined color toner from an associated one of the developing devices 210 to 213. The toner image formed on the photosensitive drum 208 is transferred onto the sheet 201 on the transfer drum 205.

By repeatedly carrying out the above-described operation, each latent image formed on the photosensitive drum 208 by the laser driver 214 in association with a desired color is developed by one of the developing devices containing the associated color toner. The toner images are superimposed one upon another on the sheet 201 on the transfer drum 205.

The sheet 201 having necessary toner images transferred thereon as described above is separated from the transfer drum 205 by a separation claw 216, and the toner images are heated and fixed by a pair of fixing rollers 217 and 217' at least one of which incorporates a fixing heater 120 (see FIG. 2). Then, the sheet 201 having an image formed thereon is conveyed by conveying rollers 218, 218', and 219, and then discharged onto a discharge tray 220.

In FIG. 2, reference numeral 223 denotes a density sensor. The density sensor 223 is configured to detect the density of each of Y, M, C, and K patch toner images formed on the photosensitive drum 208. In the present image forming apparatus, the amount of toner adhering to the photosensitive drum for development changes due to replacement of a toner cartridge or the photosensitive drum or a change in ambient temperature, humidity, etc., similarly to a general printer or the like.

For this reason, in the present image forming apparatus, the density of a toner image is measured when a part is replaced or when an ambient condition, such as temperature or humidity, has changed, or in predetermined timing defined by a predetermined time interval. In measuring the density of a toner image, a patch toner image is formed according to predetermined density data on the photosensitive drum, and the density of the patch toner image is measured by the density sensor 223, whereby a density at the time is determined.

Next, a description will be given of the arrangement of essential parts of a control system of the laser beam printer (hereinafter simply referred to as "the printer") 200 as the image forming apparatus, with reference to FIG. 1 block diagram.

Figure 1:
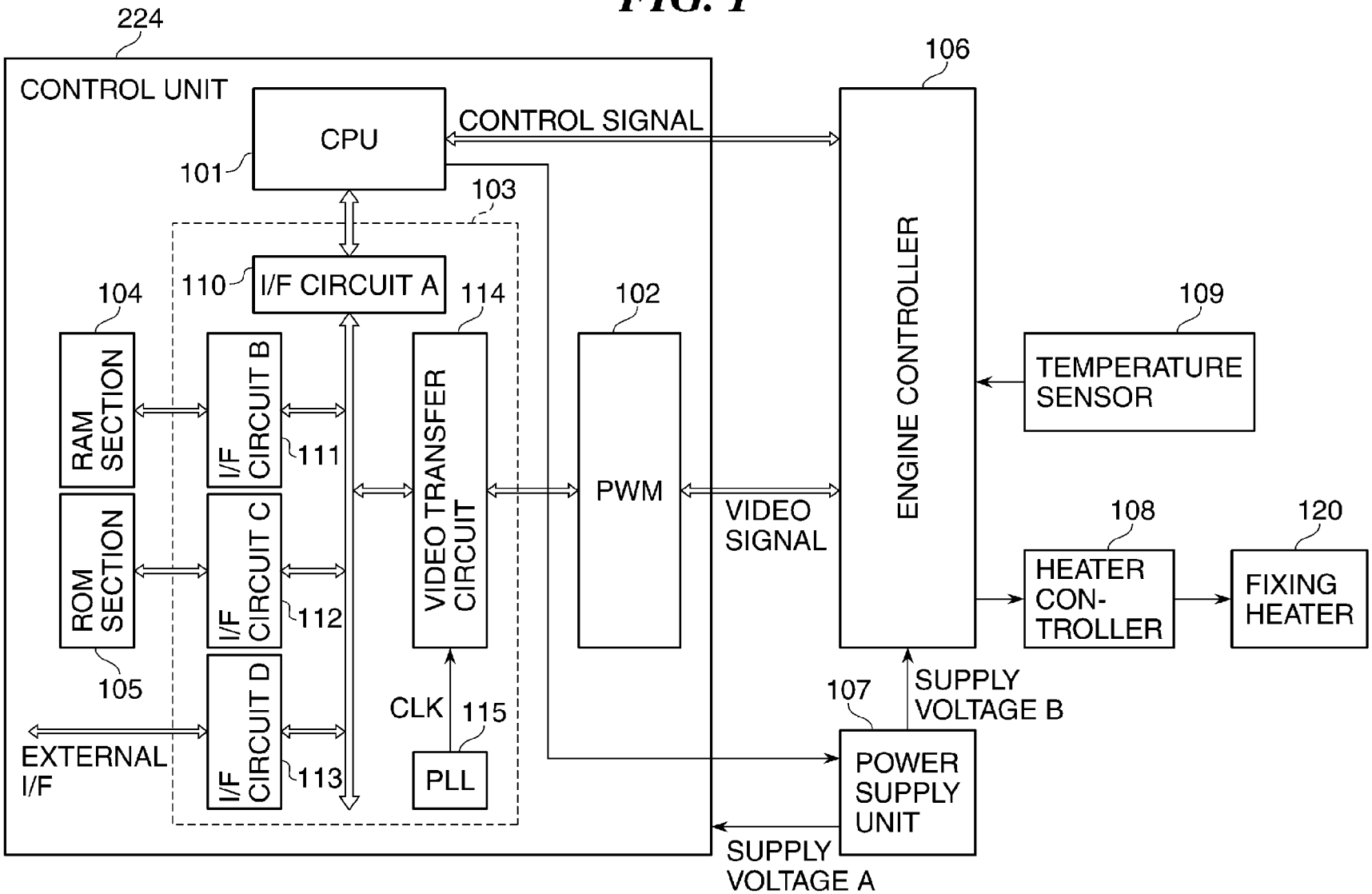
FIG. 1 is a schematic block diagram of essential parts of a control system of an image forming apparatus according to an embodiment of the present invention.

In FIG. 1, reference numeral 101 denotes a CPU that controls the overall operation of the present printer 200 by executing a control program stored in a ROM section 105.

In FIG. 1, reference numeral 104 denotes a RAM section that provides an area for storing recorded data for printing, which was sent from the host computer, and serves as a work memory that provides a work area required by the CPU 101 for execution of various control operations.

In FIG. 1, reference numeral 103 denotes an ASIC (application specific integrated circuit) that has interface circuits A 110, B 111, C 112, and D 113 each for providing interface with an external device. The interface circuit A 110 is connected to the CPU 101. The interface circuits B 111 and C 112 are connected to the RAM section 104 and the ROM section 105, respectively. The interface circuit D 113 is used as an interface with an external apparatus, and is configured to perform exchange of control signals with the host computer, reception of data therefrom, and so forth.

Further, a video transfer circuit 114 of the ASIC 103 is used for transferring image data stored in the RAM section 104, and a video CLK signal for transfer is input from a PLL (phase-locked loop) 115 to the video transfer circuit 114.

In FIG. 1, reference numeral 102 denotes a PWM (pulse width modulator) that performs correction and like processing on various images and transfers corrected video data to an engine controller 106. The engine controller 106 performs control e.g. for sheet conveyance, and causes a heater controller 108 to turn ON and OFF the fixing heater 120.

In FIG. 1, reference numeral 107 denotes a power supply unit that supplies electric power to the control unit 224 and the engine controller 106. Further, reference numeral 109 denotes a temperature sensor that monitors internal temperature of the apparatus, and provides information on the internal temperature to the engine controller 106.

The power supply unit 107 constantly supplies electric power of a supply voltage A. Further, the power supply unit 107 is configured to be capable of stopping the supply of electric power of a supply voltage B according to an instruction from the CPU 101.

The power supply unit 107 receives a signal for stopping the supply of electric power of the supply voltage B from the CPU 101 during a sleep mode to thereby stop supplying electric power to the engine controller 106. As a result, during the sleep mode, power consumption by the engine controller 106, the heater controller 108, the fixing heater 120, and the temperature sensor 109 is stopped.

During the sleep mode, in the control unit 224, the supply of electric power to the PWM 102 is stopped, and in the ASIC 103, the supply of the CLK signal to the video transfer circuit 114 is stopped by stopping the operation of the PLL 115. By further stopping the supply of the CLK signal to the RAM section 104, the control unit 224 enters a power saving state in which the CPU 101, the ROM section 105, and part of the interface circuit D 113 as an external interface alone are in operation.

The control unit 224 performs the control such that the printer 200 shifts to the sleep mode when normal printing is not performed, and returns from the sleep mode upon receipt of a print command.

Figure 3:
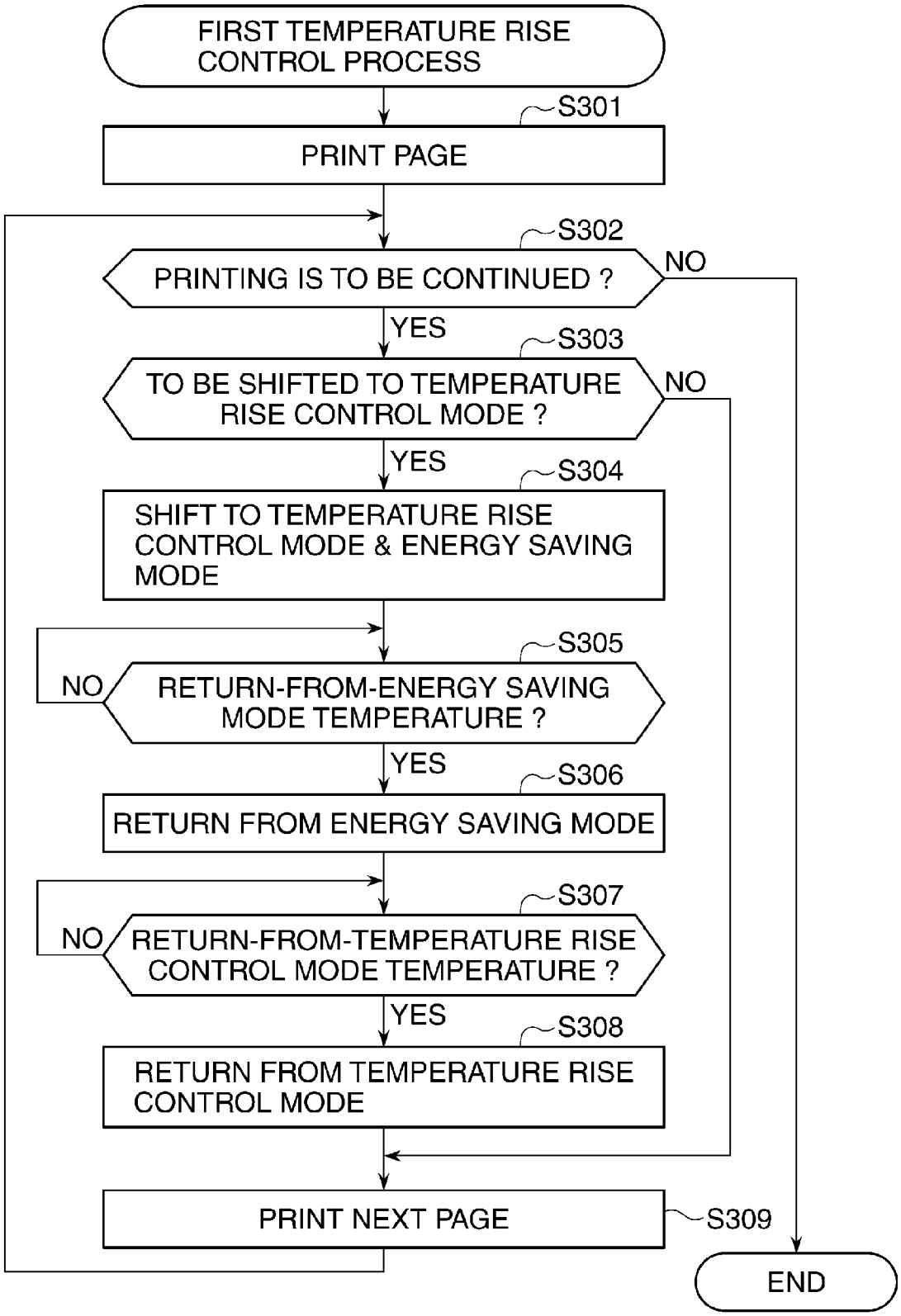
FIG. 3 is a flowchart of a first temperature rise control process executed by the image forming apparatus.

Next, a description will be given of a first temperature rise control process executed by the control system of the printer 200 shown FIG. 1, with reference to FIG. 3.

In the present printer 200, upon receipt of a print command e.g. from the host computer, not shown, the present first temperature rise control process is started. When starting printing, the CPU 101 delivers a printing start signal to the engine controller 106. The engine controller 106 having received the printing start signal outputs a sub-scanning synchronizing signal, and the PWM 102 outputs an image signal according to the sub-scanning synchronizing signal, whereby printing of a page is executed (step S301).

Next, the CPU 101 determines whether or not to continue printing (step S302). That is, the CPU 101 determines whether or not the page of which printing has just been completed is a page of a multi-page printing job except the final page thereof. Here, if it is determined that the page of which printing has just been completed is a page of a single page printing job or a final page of a multi-page printing job (NO to the step S302), the CPU 101 terminates the present process. On the other hand, if it is determined that the page of which printing has just been completed is a page of a multi-page printing job except the final page thereof, and hence printing is to be continued, the CPU 101 proceeds to a step S303.

The control system of the printer 200 is configured such that the temperature sensor 109 connected to the engine controller 106 is capable of constantly monitoring the internal temperature of the printer 200. In the first temperature rise control process, the temperature sensor 109 constantly monitors the internal temperature of the printer 200, and the CPU 101 detects information on the internal temperature of the printer 200 via the engine controller 106.

Next, the CPU 101 determines whether or not the internal temperature of the printer 200 has reached an upper limit threshold value (shift-to-temperature rise control mode temperature), at which the printer 200 should shift to a temperature rise control mode, of a temperature rise-controlling temperature range for controlling the internal temperature of the printer 200 (step S303). If it is determined that the detected temperature has not reached the shift-to-temperature rise control mode temperature (NO to the step S303), the CPU 101 proceeds to a step S309. On the other hand, if it is determined that the detected temperature has reached the shift-to-temperature rise control mode temperature (YES to the step S303), the CPU 101 proceeds to a step S304.

Next, in the step S304, the CPU 101 causes the printer 200 to shift to the temperature rise control mode and at the same time causes the same to shift to an energy saving mode. Then, after causing the printer 200 to shift to the energy saving mode, the CPU 101 causes the engine controller 106 to output a command to the heater controller 108 for turning off electric power supplied to the fixing heater 120.

Further, in the control unit 224, the supply of electric power to the PWM 102 is stopped. In the ASIC 103, the supply of the CLK signal to the video transfer circuit is stopped by stopping the operation of the PLL 115.

In the energy saving mode, differently from the sleep mode, the CPU 101 performs control such that the RAM section 104 in which image data is accumulated, the temperature sensor 109 which is monitoring the internal temperature, and so forth are held in an operable state.

Figure 4:
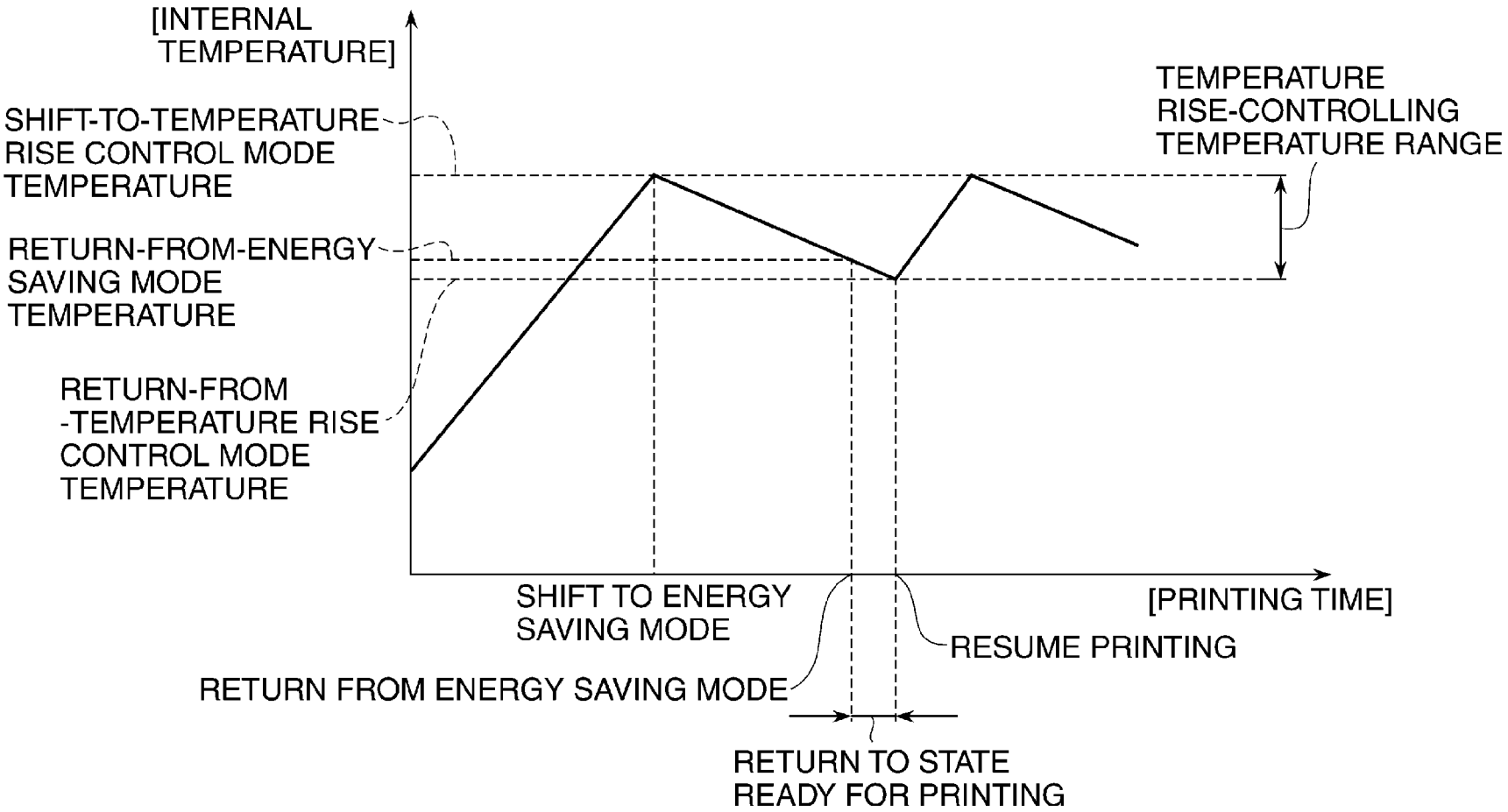
FIG. 4 is a graph showing printing time and the internal temperature of the image forming apparatus when the temperature rise control process is executed by the image forming apparatus.
Figure 5:
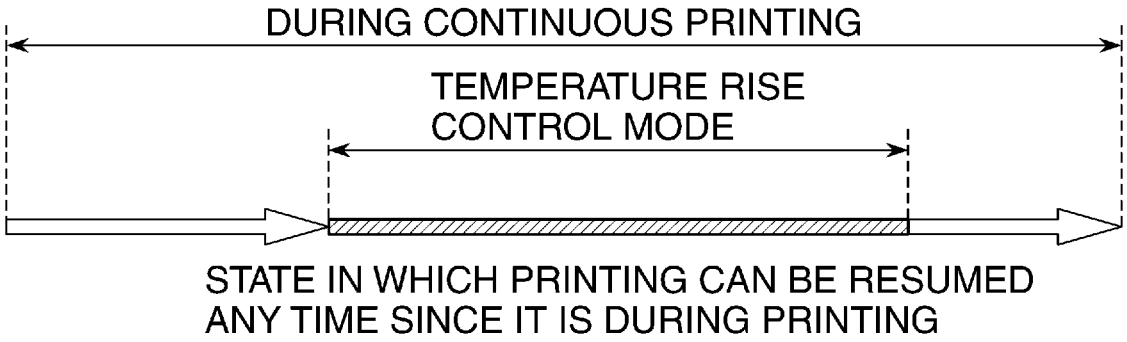
FIG. 5 RELATED ART
FIG. 5 is a diagram useful in explaining a comparative example of timing of printing, which shows printing time during continuous printing in an operation process when continuous printing is performed by the conventional image forming apparatus.

Next, the CPU 101 waits until the internal temperature of the printer 200 reaches a predetermined temperature (return-from-energy saving mode temperature) at which the printer 200 should return from the energy saving mode (NO to a step S305). As illustrated in a graph of printing time and the internal temperature shown in FIG. 4, the CPU 101 performs control such that the printer 200 shifts to the temperature rise control mode and the energy saving mode when the internal temperature has reached the aforementioned shift-to-temperature rise control mode temperature. After the printer 200 enters the temperature rise control mode, the internal temperature starts to fall due to effects of interruption of printing and energy saving. Then, when the internal temperature has fallen to the aforementioned return-from-energy saving mode temperature (YES to the step S305), the CPU 101 controls the printer 200 to return from the power saving mode (step S306).

More specifically, in the step S306, to cause the printer 200 to return from the energy saving mode and make the same ready for printing, the CPU 101 causes electric power to be supplied to the fixing heater 120 from the heater controller 108 to thereby stabilize fixing temperature. At the same time, the CPU 101 causes the PLL 115 to operate, electric power to be supplied to the PWM 102 when the frequency has been stabilized, and sets parameters for outputting video data, to the video transfer circuit 114 and the PWM 102.

Next, the CPU 101 waits until the internal temperature falls to a lower limit threshold value (return-from-temperature control mode temperature), at which the printer 200 should return from the temperature rise control mode, of the temperature rise-controlling temperature range mode (NO to a step S307), i.e. the printer 200 is permitted to resume printing, and when the internal temperature has fallen to the return-from-temperature control mode temperature (YES to the step S307), the CPU 101 proceeds to a step S308.

Next, the CPU 101 causes the printer 200 to return from the temperature rise control mode (step S308), causes the same to print a next page (step S309), and then returns to the step S302. Note that, as described hereinbefore, when it is determined in the step S302 that the printed page is a final page, the present process is terminated.

Figure 7:
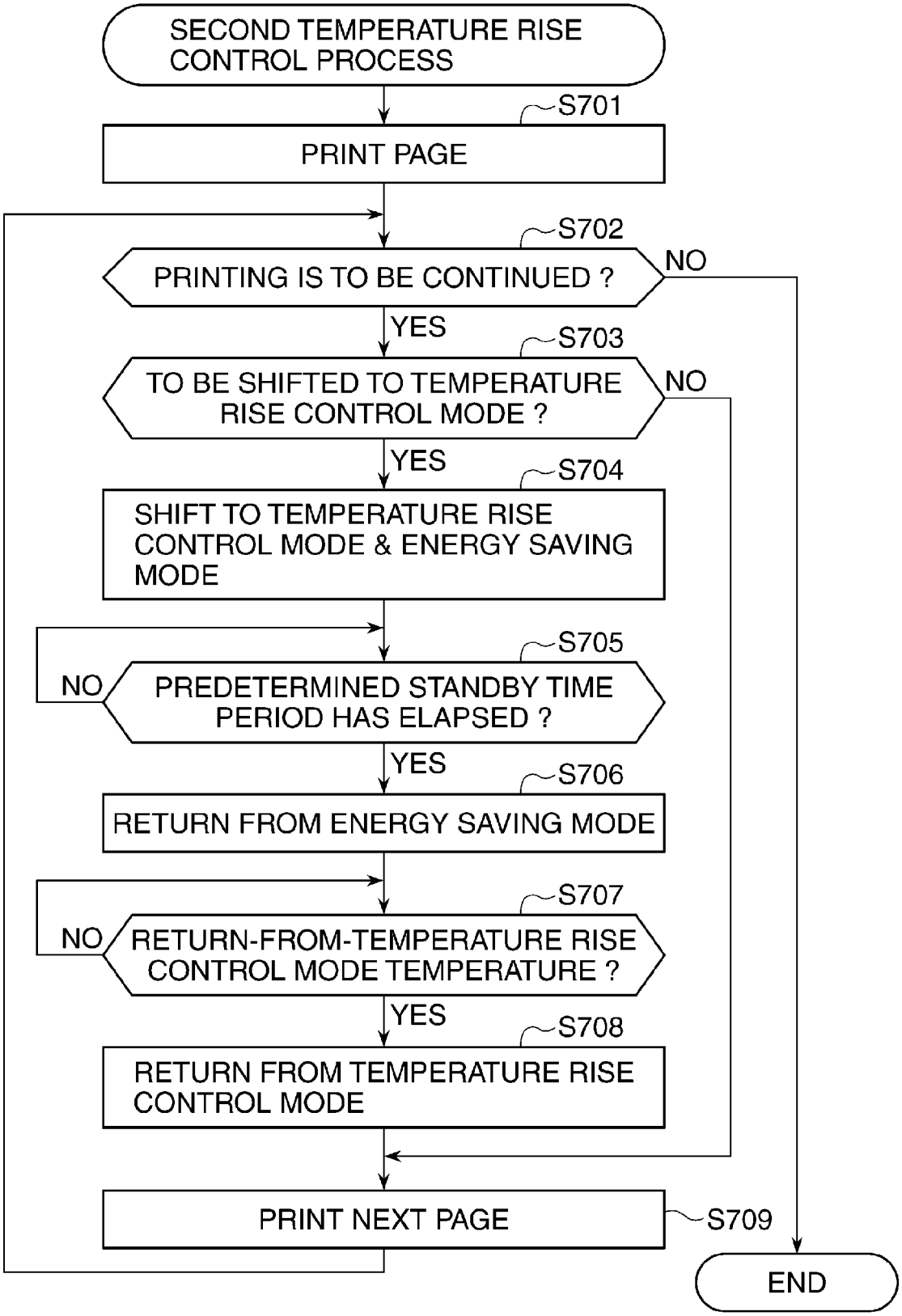
FIG. 7 is a flowchart of a second temperature rise control process executed by the image forming apparatus.

Next, a description will be given of a second temperature rise control process executed by the control system of the printer 200, with reference to FIG. 7.

The present second temperature rise control process is a variation of the first temperature rise control process in which, as described above, after starting the energy saving mode and the temperature rise control mode due to the shift-to-temperature rise control mode temperature being reached, the internal temperature is monitored, and when the internal temperature has fallen to the return-from-energy saving mode temperature, the printer 200 is caused to return from the energy saving mode. The present second temperature rise control process is distinguished from the first temperature rise control process in that when a predetermined time period (standby time period) has elapsed after the printer 200 shifting to the temperature rise control mode, the printer 200 is caused to return from the energy saving mode.

In the present printer 200, when a print command is received e.g. from the host computer, not shown, the present second temperature rise control process is started. When starting printing, the CPU 101 delivers a print start signal to the engine controller 106. The engine controller 106 having received the printing start signal outputs a sub-scanning synchronizing signal, and the PWM 102 outputs an image signal according to the sub-scanning synchronizing signal, whereby printing of a page is executed (step S701).

Next, the CPU 101 determines whether or not to continue printing (step S702). That is, the CPU 101 determines whether or not the page of which printing has just been completed is a page of a multi-page printing job except the final page thereof. Here, if it is determined that the page of which printing has just been completed is a page of a single page printing job or a final page of a multi-page printing job (NO to the step S702), the CPU 101 terminates the present process. On the other hand, if it is determined that the page of which printing has just been completed is a page of a multi-page printing job except the final page thereof, and hence printing is to be continued, the CPU 101 proceeds to a step S703.

In this second temperature rise control process, the temperature sensor 109 connected to the engine controller 106 monitors the internal temperature of the printer 200 on an as-needed basis, and the CPU 101 thus detects information on the internal temperature of the printer 200 via the engine controller 106.

Next, the CPU 101 determines whether or not the internal temperature of the printer 200 has reached the upper limit threshold value (shift-to-temperature rise control mode temperature), at which the printer 200 should shift to the temperature rise control mode, of the temperature rise-controlling temperature range for controlling the internal temperature of the printer 200 (step S703). If it is determined that the detected temperature has not reached the shift-to-temperature rise control mode temperature (NO to the step S703), the CPU 101 proceeds to a step S709. On the other hand, if it is determined that the detected temperature has reached the shift-to-temperature rise control mode temperature (YES to the step S703), the CPU 101 proceeds to a step S704.

Next, in the step S704, the CPU 101 causes the printer 200 to shift to the temperature rise control mode and at the same time causes the same to shift to the energy saving mode. After causing the printer 200 to shift to the energy saving mode, the CPU 101 causes the engine controller 106 to output a command to the heater controller 108 for turning off electric power supplied to the fixing device.

Further, in the control unit 224, the supply of electric power to the PWM 102 is stopped. In the ASIC 103, the supply of the CLK signal to the video transfer circuit is stopped by stopping the operation of the PLL 115. Furthermore, in the present variation, the CPU 101 causes the supply of electric power to the temperature sensor 109 to be stopped, as well.

In the energy saving mode, differently from the sleep mode, the CPU 101 performs control such that the RAM section 104 in which image data is accumulated and so forth are held in an operable state.

Figure 6:
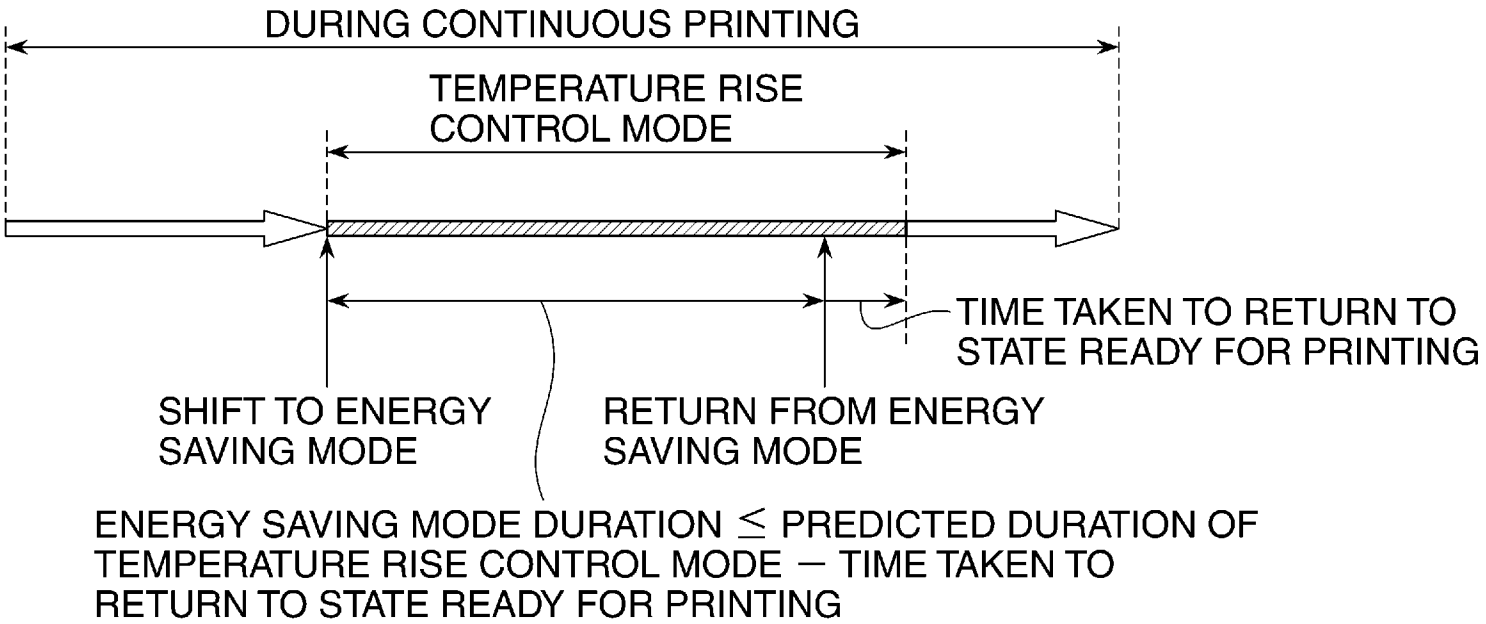
FIG. 6 is a diagram useful in explaining timing of printing, which shows printing time during continuous printing in an operation process when continuous printing is performed by the image forming apparatus according to the embodiment of the present invention.

Next, the CPU 101 waits until a predetermined standby time period elapses after the energy saving mode and the temperature rise control mode have been started (NO to a step S705). Here, as shown in FIG. 6, the predetermined standby time period is a time period obtained by subtracting a returning operation time period required for completing an operation for causing the printer 200 to return to a state ready for printing from a time period over which the temperature rise control mode is predicted to continue. That is, the predetermined standby time period is a predicted time period to elapse up to a time point going back from a time point predicted to reach the return-from-temperature rise control mode temperature, by the returning operation time period required for completing the operation for causing the printer 200 to return to the state ready for printing. Therefore, when the predetermined standby time period has elapsed (YES to the step S705) after the start of the temperature rise control mode, the internal temperature of the printer 200 is expected to have already fallen to the return-from-energy saving mode temperature, which is an intermediate internal temperature of the printer 200 during cooling thereof, and hence the CPU causes the printer 200 to return from the energy saving mode to the state ready for printing (step S706).

In this variation, the CPU 101 performs the control as described above, whereby the operation for causing the printer 200 to return from the energy saving mode to the state ready for printing is started the above-mentioned returning operation time period before the printer 200 returns from the temperature rise control mode.

Further, in this variation, after entering the energy saving mode, it is not necessary to monitor the internal temperature, and hence it is possible to stop supplying electric power to the temperature sensor 109 as well, whereby a larger effect of energy saving can be expected.

More specifically, in the step S706, to cause the printer 200 to return from the energy saving mode and make the same ready for printing, the CPU 101 causes electric power to be supplied to the fixing heater 120 from the heater controller 108 to thereby stabilize fixing temperature. At the same time, the CPU 101 causes the PLL 115 to operate, electric power to be supplied to the PWM 102 when the frequency has been stabilized, sets parameters for outputting video data, to the video transfer circuit 114 and the PWM 102, and also causes the supply of electric power to the temperature sensor 109 to be resumed.

Next, the CPU 101 confirms whether the internal temperature has fallen to the return-from-temperature rise control mode temperature (the lower limit threshold value of the temperature rise-controlling temperature range) (step S707). If the internal temperature has not fallen to the return-from-temperature rise control mode temperature (NO to the step S707), the CPU 101 waits, and if the internal temperature has fallen to the return-from-temperature rise control mode temperature (YES to the step S707), the CPU 101 proceeds to a step S708.

Next, the CPU 101 causes the printer 200 to return from the temperature rise control mode (step S708), causes the same to print a next page (step S709), and then returns to the step S702. Note that, as described hereinbefore, when it is determined in the step S702 that the printed page is a final page, the present process is terminated.

In this variation, as described hereinabove, the returning operation is started earlier, by the returning operation time period required for making the printer 200 ready for printing, than the time point at which the temperature rise control mode is predicted to be terminated (time point at which the internal temperature is expected to have already fallen below the return-from-temperature rise control mode temperature), and therefore, when the returning operation at the step S706 is completed, it is predicted that the printer 200 has already been in a state in which printing can be resumed without any problem. Therefore, the steps S707 and S708 can be omitted.

In short, the image forming apparatus according to the present embodiment, which is described, by way of example, as the printer 200, includes the temperature sensor 109 configured as a temperature detection unit for monitoring the internal temperature of the apparatus main unit. Further, the CPU 101 as a controller performs control such that when the internal temperature of the apparatus main unit detected by the temperature sensor 109 has reached the shift-to-temperature control mode temperature (the upper limit threshold value of the temperature rise-controlling temperature range), the printing operation is stopped.

Further, the CPU 101 has a temperature rise control function of causing the printing operation to be resumed when the internal temperature of the apparatus main unit detected by the temperature sensor 109 is cooled to the return-from-temperature rise control mode temperature (the lower limit threshold value of the temperature rise-controlling temperature range).

Further, in the present image forming apparatus, the CPU 101 stops energizing internal devices which can be caused to speedily return to a state in which printing can be performed, even if the energization thereof is interrupted when the printing operation is stopped by the temperature rise control function. Here, the internal devices which can be caused to speedily return to the state in which printing can be performed even if the energization thereof is interrupted include the PWM 102, the PLL 115, the RAM section 104, and so forth.

Therefore, in the present image forming apparatus, the CPU 101 causes the inside the image forming apparatus to be cooled by turning off electric power supplied to the fixing heater when the printing operation is stopped by the temperature rise control function. At the same time, in the present image forming apparatus, the CPU 101 performs such control as to stop the energization of internal devices which can be caused to return to the state in which printing can be performed even if the energization thereof is interrupted.

With this configuration, according to the present image forming apparatus, it is possible to reduce the number of heat sources which are disposed within the apparatus main unit and generate heat by being supplied with electric power, to the minimum, whereby it is possible to improve cooling efficiency and reduce cooling time.

Further, the CPU 101 performs control such that the energization of the internal devices is resumed in timing in which the internal devices energization of which is stopped can return to the state in which printing can be performed, by the time when the temperature rise control function has made it possible to resume the printing operation. This makes it possible to execute the printing operation immediately when the temperature rise control function has made it possible to resume the printing operation.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2010-264962, filed Nov. 29, 2010, which is hereby incorporated by reference herein in its entirety.

What is claimed is:

1. An image forming apparatus that can enter a first state, and a second state in which power consumption is smaller than in the first state, comprising:

an image forming unit configured to form an image on a sheet;

a fixing unit configured to fix the image on the sheet;

a detection unit configured to detect internal temperature of the image forming apparatus; and a control unit configured to control, in a case where it is detected by said detection unit that the internal temperature of the image forming apparatus has become equal to or higher than a first temperature during execution of image forming by said image forming unit, said image forming unit to stop an operation of image forming executed by said image forming unit and to control heating of the fixing unit to be stopped;

wherein the control unit is configured to control, in a case where it is detected by said detection unit that the internal temperature of the image forming apparatus has become equal to or lower than a second temperature which is lower than the first temperature, heating of the fixing unit to be resumed, and then control, in a case where it is detected by said detection unit that the internal temperature of the image forming apparatus has become equal to or lower than a third temperature which is lower than the second temperature, said image forming unit to resume the operation of image forming.

2. The image forming apparatus according to claim 1, wherein, in a case where it is detected by said detection unit that the internal temperature of the image forming apparatus becomes equal to or higher than the first temperature, said control unit shifts the electric power state of the image forming apparatus to the second state, and then in a case where it is detected by said detection unit that the internal temperature of the image forming apparatus becomes equal to or lower than the second temperature, said control unit shifts the electric power state of the image forming apparatus from the second state to the first state.

3. The image forming apparatus according to claim 1, wherein when a predetermined time period has elapsed from a time point when the electric power state of the image forming apparatus has been shifted to the first state, said power control unit shifts the electric power state of the image forming apparatus to the second state.

4. The image forming apparatus according to claim 1, wherein the predetermined time period is obtained by subtracting a time required to shift the electric power state of the image forming apparatus from the second state to the first state from a time period which is predicted to take the internal temperature of the image forming apparatus to become equal to or lower than the third temperature.

5. The image forming apparatus according to claim 1, wherein said power control unit is configured to supply electric power to a transmission unit for use in transmitting image data to said image forming unit, in the first state, and stops supplying electric power to the transmission unit, in the second state.

6. A method of controlling an image forming apparatus that can enter a first state, and a second state in which power consumption is smaller than in the first state, comprising:

forming an image on a sheet;

fixing, with a fixing unit, the image on the sheet;

detecting internal temperature of the image forming apparatus;

causing, in a case where it is detected by said detecting that the internal temperature of the image forming apparatus has become equal to or higher than a first temperature during execution of image forming, an operation of image forming to be stopped and controlling heating of the fixing unit to be stopped; and controlling, in a case where it is detected by said detection step that the internal temperature of the image forming apparatus has become equal to or lower than a second temperature which is lower than the first temperature, heating of the fixing unit to be resumed, and then controlling, in a case where it is detected by said detection step that the internal temperature of the image forming apparatus has become equal to or lower than a third temperature which is lower than the second temperature, said image forming unit to resume the operation of image forming.

7. A non-transitory computer-readable storage medium storing a computer-executable program for causing a computer to execute a method of controlling an image forming apparatus that can enter a first state, and a second state in which power consumption is smaller than in the first state, wherein the method comprises:

forming an image on a sheet;

fixing, with a fixing unit, the image on the sheet;

detecting internal temperature of the image forming apparatus;

causing, in a case where it is detected by said detecting that the internal temperature of the image forming apparatus has become equal to or higher than a first temperature during execution of image forming, an operation of image forming to be stopped and controlling heating of the fixing unit to be stopped; and controlling, in a case where it is detected by said detection step that the internal temperature of the image forming apparatus has become equal to or lower than a second temperature which is lower than the first temperature, heating of the fixing unit to be resumed, and then controlling, in a case where it is detected by said detection step that the internal temperature of the image forming apparatus has become equal to or lower than a third temperature which is lower than the second temperature, said image forming unit to resume the operation of image forming.

* * * * *